US012345496B2

(12) United States Patent
Merklin et al.

(10) Patent No.: US 12,345,496 B2
(45) Date of Patent: Jul. 1, 2025

(54) FLASH BANG GRENADE HOOK AND METHOD OF USE

(71) Applicant: ICARUS PRECISION LLC, Washougal, WA (US)

(72) Inventors: Travis Merklin, Washougal, WA (US); Randall Strand-Poole, Graham, WA (US)

(73) Assignee: ICARUS PRECISION LLC, Washougal, WA (US)

( * ) Notice: Subject to any disclaimer, the term of this patent is extended or adjusted under 35 U.S.C. 154(b) by 0 days.

(21) Appl. No.: 18/409,477

(22) Filed: Jan. 10, 2024

(65) Prior Publication Data

US 2024/0247905 A1 Jul. 25, 2024

Related U.S. Application Data

(60) Provisional application No. 63/481,018, filed on Jan. 23, 2023.

(51) Int. Cl.

| | |
|---|---|
| ***F41A 35/00*** | (2006.01) |
| ***F41C 33/00*** | (2006.01) |
| ***F42B 27/00*** | (2006.01) |
| ***F42C 15/20*** | (2006.01) |

(52) U.S. Cl.

CPC ..... *F41A 35/00* (2013.01); *F41C 33/007* (2013.01); *F41C 33/008* (2013.01); *F42B 27/00* (2013.01); *F42C 15/20* (2013.01)

(58) Field of Classification Search

CPC ..... F41A 35/00; F42B 27/00; F42C 15/20; F41C 33/006; F41C 33/007; F41C 33/008

See application file for complete search history.

(56) References Cited

U.S. PATENT DOCUMENTS

| | | | | | |
|---|---|---|---|---|---|
| 897,577 | A * | 9/1908 | Bourne | F41C 23/10 | 42/59 |
| 2,320,450 | A * | 6/1943 | Valenzuela | F41C 33/02 | 24/3.12 |
| 2,926,448 | A * | 3/1960 | Stam | F41C 23/16 | 42/71.01 |
| 3,156,059 | A * | 11/1964 | Crain | F41C 33/008 | 42/71.02 |
| 5,630,535 | A * | 5/1997 | Valenti | F41C 33/008 | 224/667 |
| 6,810,614 | B2 * | 11/2004 | Phillips | F41C 27/00 | 42/75.01 |

(Continued)

*Primary Examiner* — Joshua E Freeman

(74) *Attorney, Agent, or Firm* — Miller Nash LLP

(57) ABSTRACT

A hook for deploying a pin-and-lever detonation device, such as a flash bang grenade, and a method for use of the hook, is disclosed. The hook includes a base for attaching the hook to the side of a firearm, such as at a hand guard, grip, body, or accessory rail. It further includes an arm extending substantially laterally from the base. A recess is defined between the base and the arm, structured to receive a pull-ring of the pin-and-lever detonation device and provide leverage for a user pulling the pull-ring. A lip is formed at an end of the arm, structured to curve away from the arm and guide a pull-ring of the pin-and-lever detonation device into the recess. The disclosed hook enables an operator to deploy a grenade one-handed while simultaneously keeping his firearm readily available and covering his own person.

4 Claims, 8 Drawing Sheets

(56) References Cited

U.S. PATENT DOCUMENTS

| | | | | |
|---|---|---|---|---|
| 6,951,072 | B2 * | 10/2005 | Schurtenberger | F41C 27/00 42/94 |
| 7,104,262 | B2 * | 9/2006 | Yorns | B25H 3/006 248/689 |
| 8,523,030 | B1 * | 9/2013 | Molcho | F41C 33/0281 224/660 |
| 8,776,426 | B1 * | 7/2014 | Symonds | F41A 17/38 42/49.02 |
| 8,839,546 | B2 * | 9/2014 | Taylor | F41C 33/007 42/107 |
| 10,451,377 | B1 * | 10/2019 | Shieh | F42B 27/00 |
| 11,585,634 | B2 * | 2/2023 | Wessels | F41C 33/007 |
| 2003/0000123 | A1 * | 1/2003 | Phillips | F41C 27/00 42/85 |
| 2004/0068911 | A1 * | 4/2004 | Schurtenberger | F41A 23/02 42/94 |
| 2012/0030986 | A1 * | 2/2012 | Swan | F41C 33/007 42/90 |
| 2014/0190054 | A1 * | 7/2014 | Ascano | F41C 33/005 42/71.01 |
| 2016/0040957 | A1 * | 2/2016 | Finsand | F41C 33/008 224/269 |
| 2021/0285740 | A1 * | 9/2021 | Wessels | F41C 33/007 |

* cited by examiner

100

100

503

FLASH BANG GRENADE HOOK AND METHOD OF USE

CROSS-REFERENCE TO RELATED APPLICATIONS

This disclosure claims benefit of U.S. Provisional Application No. 63/481,018, titled "FLASH BANG GRENADE HOOK AND METHOD OF USE," filed on Jan. 23, 2023, the disclosure of which is incorporated herein by reference in its entirety.

FIELD OF THE INVENTION

This disclosure is directed to a hook for firearms enabling eased deployment of flash bang grenades and other similarly activated devices, and a method of use of the same.

BACKGROUND

Flash bang grenades, also known as stun grenades, are a type of device deployed in military, law enforcement, corrections, and civilian applications to distract people. In doing so, flash bang grenades provide "cover" for the individual that deploys them, as well as persons immediately around him. Flash bang grenades can be used to gain compliance, disperse crowds, restore order, or temporarily incapacitate persons.

Unlike a standard grenade, flash bang grenades are non-lethal. They do not fragment and send out shrapnel like a fragmentation grenade; rather, when they detonate they emit a bright flash, a loud sound, and/or smoke or other non-lethal material. Similarly, smoke grenades are also a non-lethal device that emits smoke when detonated. Flash bang grenades and smoke grenades can thus be used to stun and distract the persons nearby them when they detonate, not physically harm or kill such persons like a fragmentation grenade would.

Flash bang grenades and smoke grenades are similar in construction and operation to a fragmentation grenade. They include a body, which contains the filler released upon detonation; the filler inside the body, typically composed of chemical or explosive substances; a fuse assembly, which causes the grenade to explode by detonating the filler; a lever or "spoon" that is squeezed by the user's hand; and a pin with a ring that is twisted and pulled out of the device to make the device live. The grenade will not detonate until the lever is released.

To use a flash bang grenade, the user holds the grenade body in one hand, squeezing the lever in toward the grenade body, and uses her other hand to release the pin by grabbing the ring and using it to pull the pin out of the grenade. She then throws the grenade away from her body, releasing the lever, which causes the fuse to detonate the filler a prescribed time after the lever is released, typically a few seconds. Depending on the type of filler, the flash bang grenade will emit a loud sound (typically between 160 and 180 decibels), a flash of light, and/or smoke or other non-lethal matter. The main difference between a flash bang grenade and a fragmentation grenade is the housing of the flash bang grenade does not itself fragment upon detonation nor does it contain any fragmentation filler, such that the flash bang grenade does not disperse shrapnel upon detonation. Fragmentation grenades include the same type of lever-and-pin detonation assembly, and thus require the same sort of two-handed operation that a flash bang grenade requires.

Given their non-lethal nature, flash bang grenades are useful in military and law enforcement situations where their users need to quickly gain control of the situation without physically harming anyone. For instance, flash bang grenades are used in military operations to provide protection to troops prior to entering a space with combatants. In that case, one troop without a firearm operates and deploys the flash bang grenade, signaling to other troops that have firearms that he is doing so; once the grenade detonates, the troops with firearms can enter the space and quickly secure it while the unarmed troop stands back. Flash bang grenades are used in a similar manner by law enforcement looking to enter a space with suspects. One officer without a firearm again operates and deploys the flash bang grenade, signaling to other, armed officers that he is doing so, and once it detonates, the armed officers can enter and secure the space while the unarmed officer stands back. Alternatively, the user can himself be armed, but since two hands are needed to deploy the grenade, he must put down his weapon while deploying the grenade, leaving himself temporarily unprotected.

Flash bang grenades can also be used in civilian applications. For example, flash bang grenades can be used to distract competitors during paintball or airsoft matches. In paintball applications, the housing may contain a paint concoction in addition to the other fillers, thereby spraying non-lethal paint on competitors when the grenade detonates.

A downside to use of flash bang grenades in any application is that they require two hands to operate: one hand to pull the pin on the grenade, and one hand to hold and throw the grenade. It is therefore not possible for a person to simultaneously hold a firearm and deploy a flash bang grenade. Instead, the person must either put down his firearm, leaving himself exposed while deploying the grenade, or the two-person method described above used by the military and law enforcement must be used. In either case, the person deploying the flash bang grenade is left at least partially unprotected while he is in the process of deploying the device. Embodiments of the invention address these and other limitations.

DETAILED DESCRIPTION OF THE EMBODIMENTS

The embodiments described herein provide a hook for a firearm that enables the firearm's operator to deploy flash bang grenades or other similar devices with a single hand, without having to lower or put down his firearm, and a method of using said hook.

Figure 1:
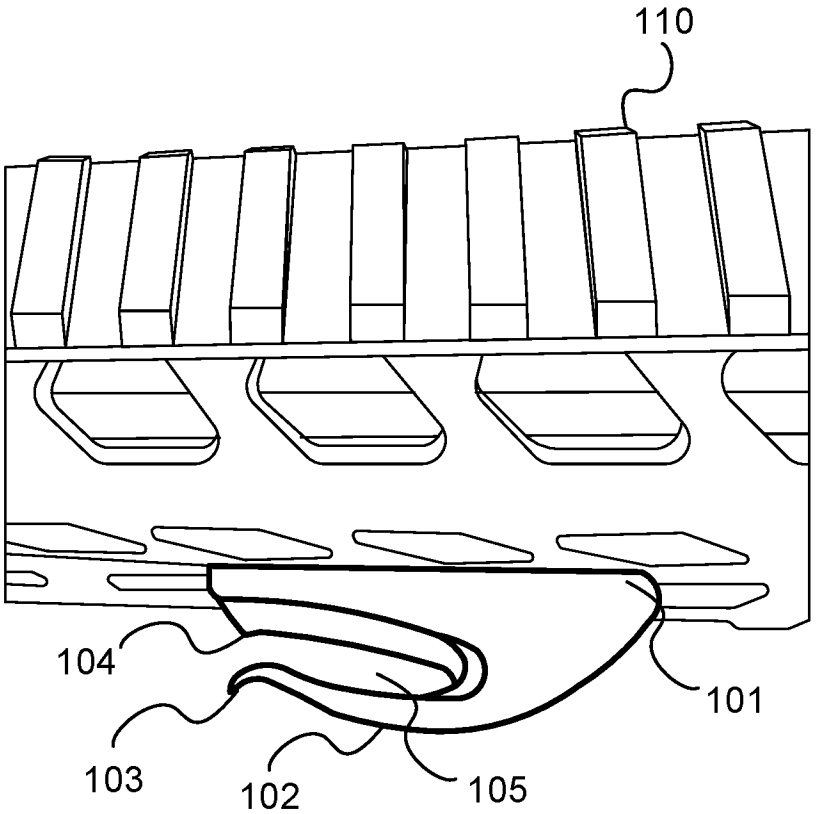
FIGS. 1-3 are perspective views of a grenade hook according to embodiments of the invention.
Figure 2:
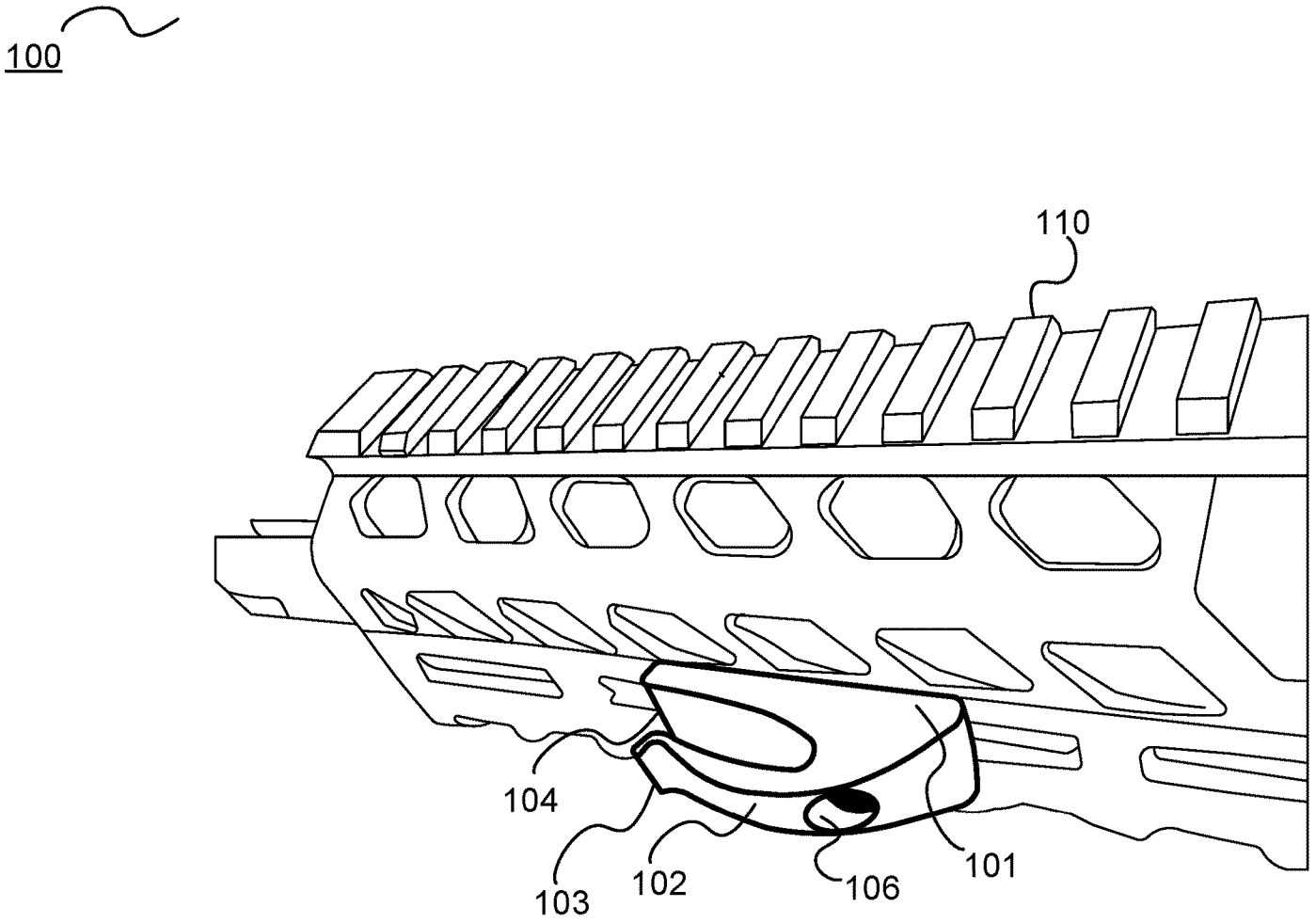
Figure 3:
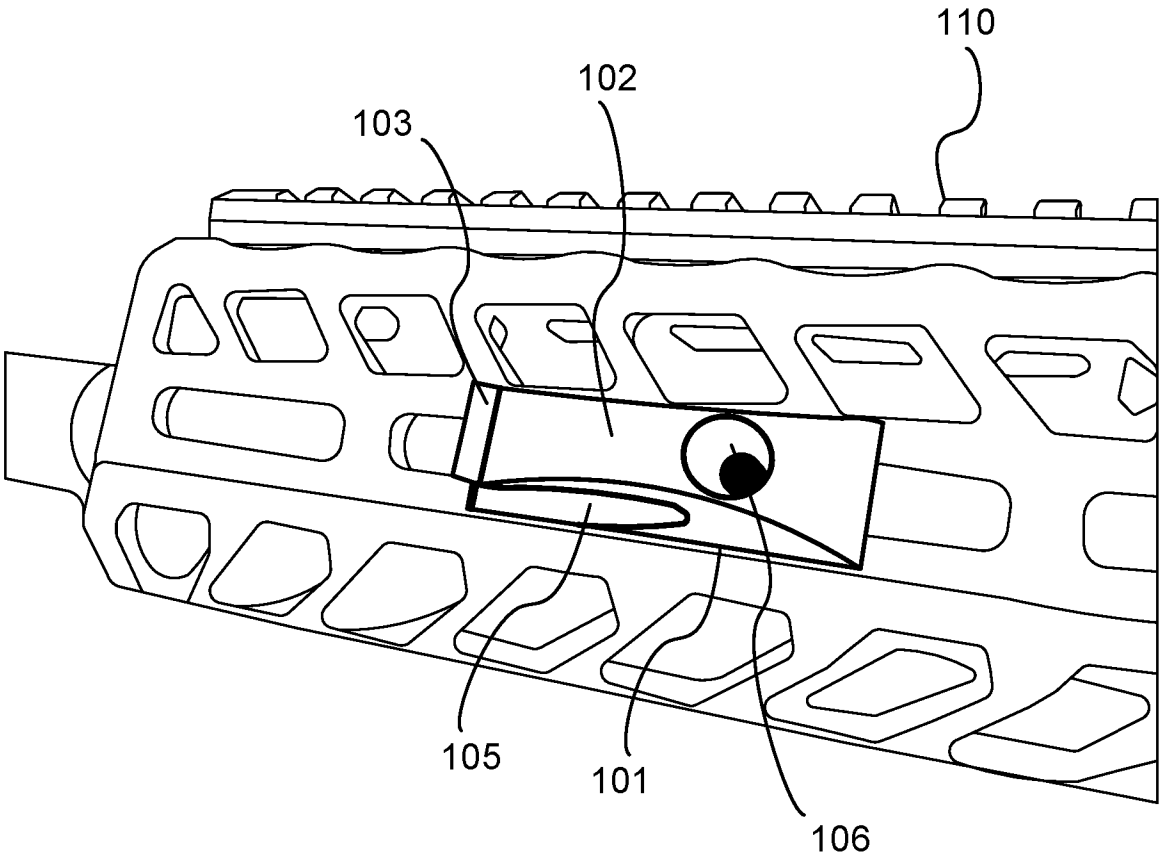

FIGS. 1-3 show a grenade hook 100 according to an embodiment of the invention. In an embodiment, grenade hook 100 is a separate piece from firearm 110 and is attached to firearm 110 via a screw hole-and-screw assembly 106. Grenade hook 100 may be alternatively attached to firearm 110 through any other known means, such as but not limited to bolt and nut, or other threaded means, including industry standard ways to mount or connect accessories to firearms such as M-LOK® or KeyMod™ mounting systems. Hook 100 may be attached to the firearm's hand guard, grip, body, or accessory rail. In another embodiment of the invention, grenade hook 100 and firearm 110 are formed as a single piece; hook 100 may be formed on the guard, grip, or body of firearm 110. For instance, hook 100 may be monolithic with a firearm hand guard, upper/lower receiver, or pistol grip.

In an embodiment, grenade hook 100 includes base 101, which mounts with a side of firearm 110. Hook 100 may be mounted on the left-hand side of firearm 110 so that hook 100 can be used with an operator's left hand, or on the right-hand side of firearm 110 so that the hook 100 can be used with the operator's right hand. In another embodiment, a hook 100 may be mounted on each side of the firearm 110, so that the operator can use hook 100 with either hand.

In an embodiment, grenade hook 100 further includes arm 102 extending substantially laterally from the base 101 of hook 100. For purposes of this disclosure, "substantially laterally" means largely or essentially from the side, without requiring perfect linearity in a single direction. In this way, grenade hook 100 extends from the side of the firearm and along the length of the firearm. The outer surface of arm 102 may be generally curved, arcuate, or convex in shape. In an embodiment, arm 102 further includes lip 103 located substantially at the end of arm 102, which curves outward from arm 102 and away from the firearm 110. In this manner, lip 103 can help guide the ring of a grenade through opening 104 of hook 100 and into recess 105 of hook 100 during use of the hook 100. In an embodiment, recess 105 is substantially concave in shape, permitting the ring of a grenade to slip easily into recess 105 during use of hook 100. For purposes of this disclosure, "substantially concave" means largely or essentially curved inward, without requiring perfect inward curvature. In this way, as shown in FIGS. 1 and 2, recess 105 may curve toward the outer surface of arm 102 on the side of hook 100 having arm 102 and may curve toward the body of firearm 110 on the side of hook 100 having base 101.

Figure 4:
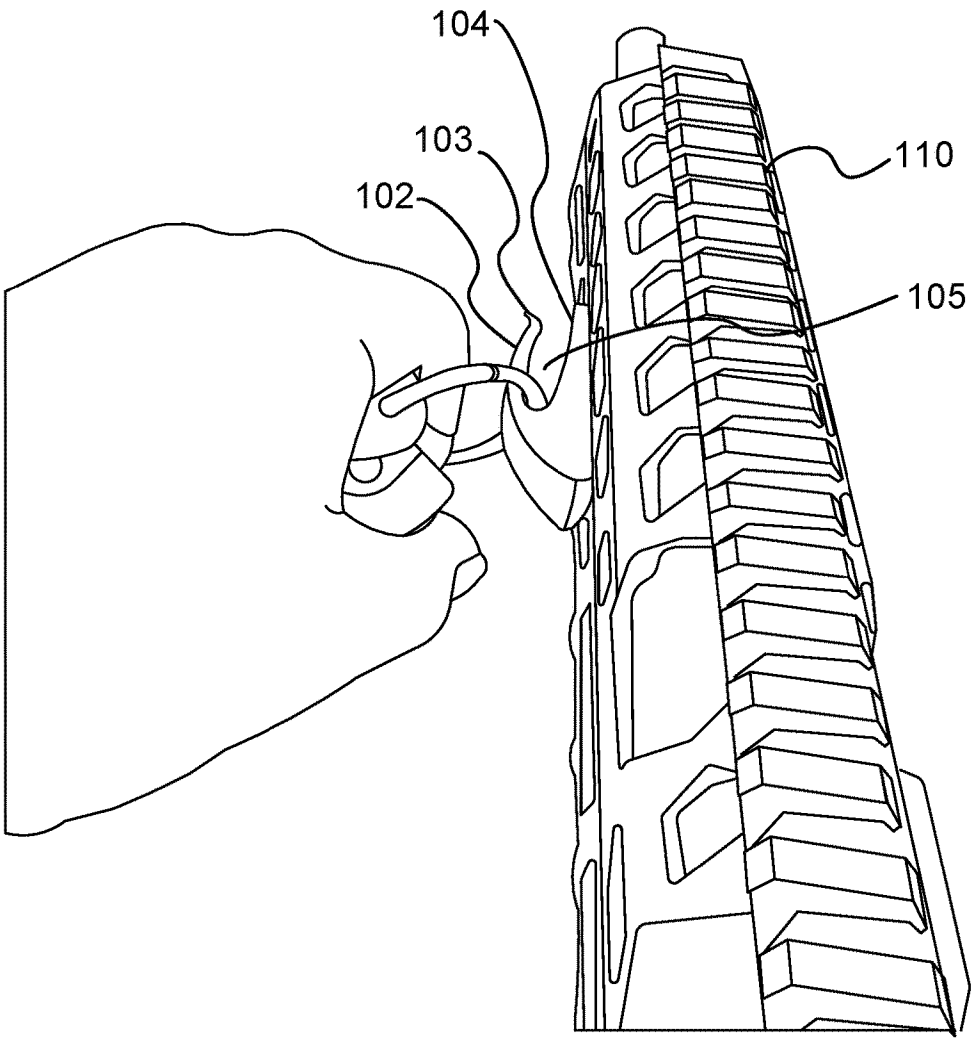
FIG. 4 is a perspective view of a grenade hook according to embodiments of the invention showing the relationship of the hook to a grenade pin during use of the hook.
Figure 5:
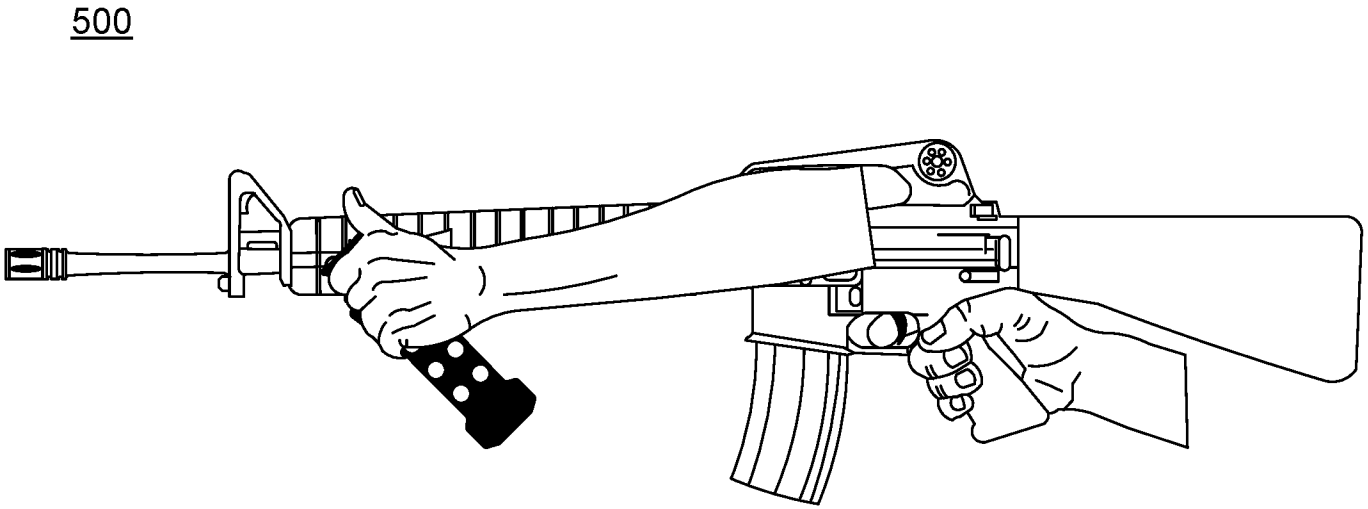
FIGS. 5-8 are views of exemplary steps of a method of use of the grenade hook with a grenade according to embodiments of the invention.
Figure 6:
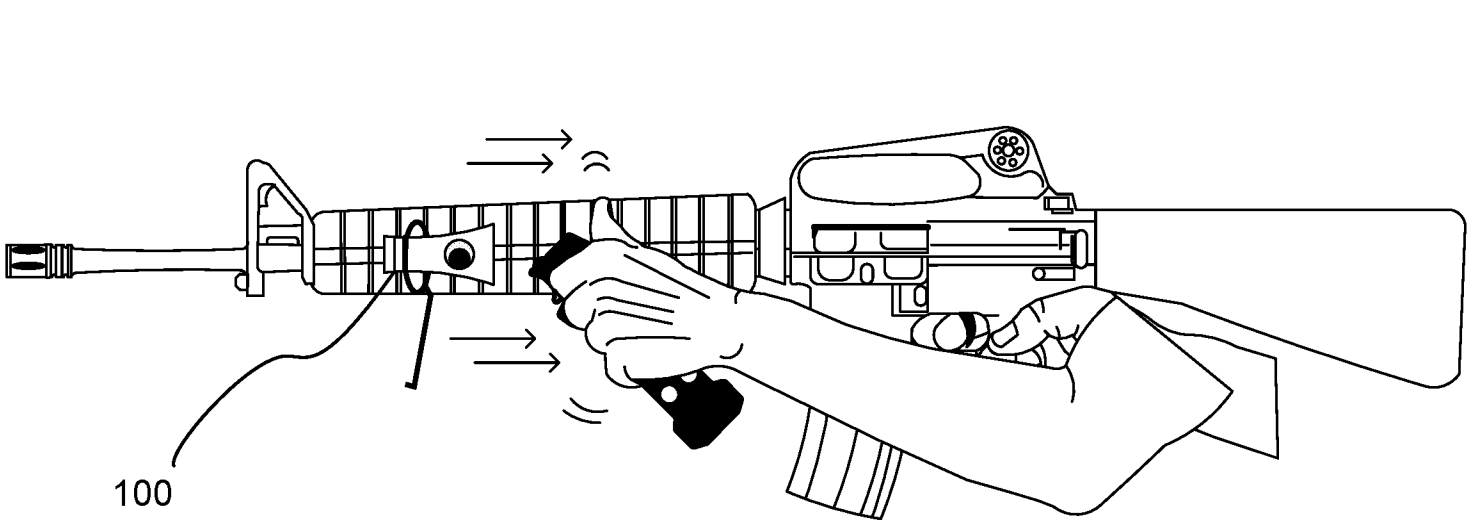
Figure 7:
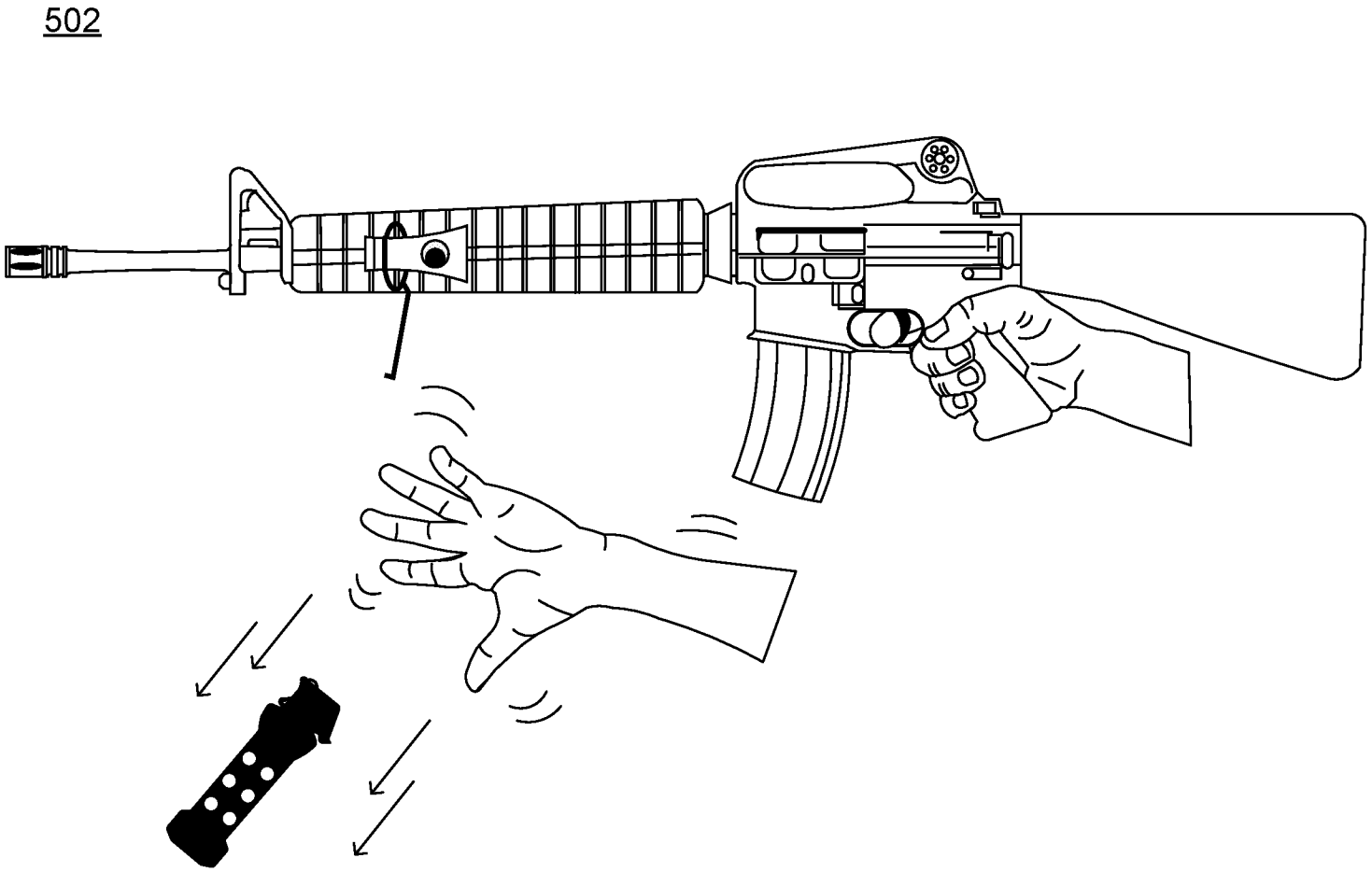
Figure 8:
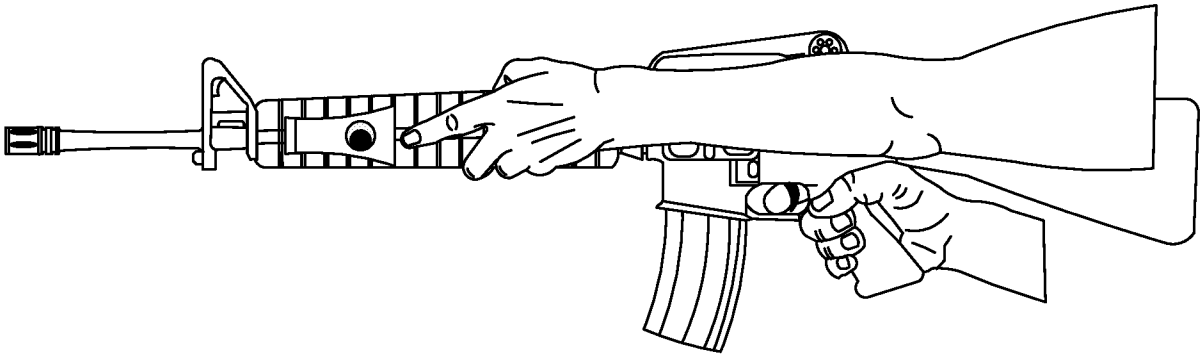

FIG. 4 shows an embodiment of grenade hook 100 in use. Hook 100 is attached to firearm 110 such that opening 104 of hook 100 is pointed toward the front of the firearm 110, away from the firearm's operator. In use, arm 102 of hook 100 is used to snag or catch the ring of the grenade. In the embodiment shown in FIG. 4, arm 102 includes lip 103, which helps guide the ring of the grenade through opening 104 and into recess 105 of hook 100. In this manner, hook 100 provides the operator with sufficient leverage to pull the pin from the grenade using only one hand, while keeping her firearm directed towards the threat or potential threat using the other hand.

FIGS. 5-8 illustrate a method of use of grenade hook 100 according to an embodiment of the invention. In step 500 (FIG. 5), the operator uses hook 100 to snag or catch the ring on his grenade. In embodiments having a lip, the operator uses the lip to guide the ring onto hook 100 and into the recess 105. In step 501 (FIG. 6), the operator pulls his hand holding the grenade backward toward his body, such that the leverage created by hook 100 pulls the pin from the grenade utilizing only one of the operator's hands, while the operator keeps his firearm directed towards the threat or potential threat using the other hand. In step 502 (FIG. 7), the operator throws the grenade away from his body, again using an available hand to keep his firearm directed towards the threat or potential threat. Finally, in step 503 (FIG. 8), the operator places the hand used to deploy the grenade back on his firearm.

In prior art methods of grenade deployment, a firearm operator must first lower his weapon so that he can use both hands to deploy the grenade: one hand to hold the grenade body, and one hand to pull the ring out of the grenade and toss the grenade away from his person. This leaves the firearm operator exposed. Or, in alternative prior art methods, the person deploying a grenade does not himself have a firearm at all but is instead reliant on other persons around him to provide him cover with their firearms while he deploys the grenade using both hands.

Hook 100 overcomes these shortcomings by enabling an operator to deploy a grenade while simultaneously keeping his own firearm readily available and covering his own person. By mounting hook 100 on firearm 110, the operator can pull out the grenade with one hand, snag the safety pin ring on hook 100, pull the grenade back towards himself removing the safety pin ring on the grenade, and then toss the grenade away from his person. This can be done using only one hand, enabling the operator to keep his firearm on a potential target, and thus not leave himself defenseless during deployment of the grenade.

Hook 100 can be used with flash bang grenades or any other similarly deployed, non-lethal distraction devices, such as smoke grenades. Hook 100 can alternatively or additionally be used with standard, fragmentation grenades, or any other similarly deployed destructive device. Hook 100 can be used with lethal weapons, such as firearms, or with non-lethal weapons, such as paintball or air soft guns. It can be used in military, law enforcement, corrections, or civilian applications. Hook 100 can be formed of any material of sufficient strength to provide sufficient leverage with which to remove the pin or other detonation means from a device, such as but not limited to aluminum, steel, stainless steel, titanium and all other exotic/super alloys, or plastic/polymer.

The previously described versions of the disclosed subject matter have many advantages that were either described or would be apparent to a person of ordinary skill familiar with the disclosure herein. Even so, all of these advantages or features are not required in all versions of the disclosed apparatus, systems, or methods. All features disclosed in the specification, and all the steps in any method or process disclosed, may be combined in any combination, except combinations where at least some of such features and/or steps are mutually exclusive. Each feature disclosed can be replaced by alternative features serving the same, equivalent, or similar purpose, unless expressly stated otherwise.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this specification to a method having two or more defined steps or operations, the defined steps or operations can be carried out in any order or simultaneously, unless context excludes those possibilities.

Further, the term "comprises" and its grammatical equivalents are used in this specification to mean that other components, features, steps, processes, operations, etc. are optionally present. For example, an article "comprising" or "which comprises" components A, B, and C can contain only components A, B, and C, or it can contain components A, B, and C along with one or more other components.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the embodiments.

What is claimed is:

1. A method for deploying a pin-and-lever detonation device with one hand, the method comprising the steps of:

holding the detonation device in one hand;

sliding a pull-ring of the detonation device over a hook attached to a side of a firearm, the hook being structured to provide leverage for pulling the pull-ring;

pulling the detonation device away from the hook; and throwing the detonation device.

2. The method of claim 1, in which sliding the pull-ring over the hook further comprises guiding the pull-ring with a lip at an end of the hook, the lip structured to curve away from the hook.

3. The method of claim 1, in which sliding the pull-ring over the hook further comprises sliding the pull-ring into a recess of the hook.

4. The method of claim 1, in which pulling the detonation device away from the hook comprises removing a pin of the detonation device utilizing one hand.

* * * * *